US010405592B2

(12) United States Patent
Kim

(10) Patent No.: US 10,405,592 B2
(45) Date of Patent: Sep. 10, 2019

(54) GLOVE

(71) Applicant: Woo Tae Kim, Seoul (KR)

(72) Inventor: Woo Tae Kim, Seoul (KR)

( * ) Notice: Subject to any disclaimer, the term of this patent is extended or adjusted under 35 U.S.C. 154(b) by 368 days.

(21) Appl. No.: 15/329,571

(22) PCT Filed: Jul. 27, 2015

(86) PCT No.: PCT/KR2015/007804
§ 371 (c)(1),
(2) Date: Jan. 26, 2017

(87) PCT Pub. No.: WO2016/018019
PCT Pub. Date: Feb. 4, 2016

(65) Prior Publication Data

US 2017/0208879 A1 Jul. 27, 2017

(30) Foreign Application Priority Data

Jul. 30, 2014 (KR) ..... 10-2014-0097292

(51) Int. Cl.
*A41D 13/08* (2006.01)
*A41D 19/015* (2006.01)
*A63B 71/14* (2006.01)

(52) U.S. Cl.
CPC ..... *A41D 19/01523* (2013.01); *A63B 71/141* (2013.01); *A41D 19/01588* (2013.01); *A41D 2600/10* (2013.01); *A41D 2600/102* (2013.01); *A41D 2600/20* (2013.01)

(58) Field of Classification Search
CPC ..... A63B 71/143; A63B 71/71; A63B 102/12; A63B 102/24; A41D 19/02; A41D 19/043
USPC ..... 2/16
See application file for complete search history.

(56) References Cited

U.S. PATENT DOCUMENTS 4,768,234 A * 9/1988 Yamamoto ..... A41D 19/01523 2/16
5,168,576 A * 12/1992 Krent ..... A41D 13/0156 2/456
7,406,719 B2 8/2008 Aoki
8,356,366 B2 * 1/2013 Fiegener ..... A41D 27/28 2/159
2011/0265238 A1 11/2011 Choi et al.
2012/0011633 A1 1/2012 Van Hale
(Continued)

FOREIGN PATENT DOCUMENTS

JP 2008-264366 A 11/2008
KR 20-1999-0001747 U 1/1999
(Continued)

*Primary Examiner* — Timothy K Trieu
(74) *Attorney, Agent, or Firm* — Im IP Law; C. Andrew Im; Chai Im

(57) ABSTRACT

A glove includes spaces formed at parts corresponding to the knuckle part of the hand and joint parts of the fingers to guarantee the movement and protection of the knuckle part and the joint parts. The glove also includes protection members longitudinally formed in a shape corresponding to each finger, thereby effectively protecting all the fingers. The protection members are formed from a lightweight, soft material, thereby reducing the fatigue of a wearer due to wear sensation. A cover member is formed from a rigid material to protect the hand and each of the protection members from the outside.

15 Claims, 10 Drawing Sheets

(56) References Cited

U.S. PATENT DOCUMENTS

2012/0131725 A1* 5/2012 Copeland ..... A63B 71/143
2/161.1

FOREIGN PATENT DOCUMENTS

KR 10-2011-0115206 A 10/2011
KR 10-1165213 B1 7/2012

* cited by examiner

GLOVE

RELATED APPLICATIONS

This application is a § 371 application from PCT/KR2015/007804 filed Jul. 27, 2015, which claims priority from Korean Patent Application No. 10-2014-0097292 filed Jul. 30, 2014, each of which is incorporated herein by reference in its entirety.

TECHNICAL FIELD

The present invention relates to a glove, and more particularly, to a glove that is capable of improving the movements, impact resistances, and protective functions for the knuckles of the hand, all fingers, and the joints of the fingers and further achieving lightness.

BACKGROUND ART

Generally, gloves are made adequately to improve workability, safety, and efficiency in daily life or various industrial or sports fields. Further, gloves, which are used in working places having bad environments and requiring safety, such as an oil sand collection place, oil well and the like, are specially designed to ensure the movement of the hand and at the same time to protect the hand and fingers from the outside.

One example of conventional gloves is disclosed in U.S. Pat. No. 7,406,719 in which impact alleviating members are inserted into finger parts of a glove. Each impact alleviating member includes a cover part bendable and made of a hard material and a core part formed integrally with the cove part and made of a soft material. The glove protects and releases the impact applied from the outside by means of the cover part, and each finger is protected from the impact by means of the soft core part.

On the other hand, recently, a working glove, which is made by a glove manufacturing company KONG in U.S.A., is provided for bad working environments such as an oil sand collection place, oil well and the like. As shown in FIGS. 1 to 3, the working glove includes a main part 1 for inserting a user's hand in such a manner as to come into contact with the back of the hand, the palm of the hand, and the fingers. The main body 1 includes a body part 2 for inserting the back of the hand and the palm of the hand and finger parts 3 formed unitarily with the body part 2. Further, the glove includes a protection member 4 attached integrally to the upper side of the body part 2 so as to protect the back of the hand and a protection member 5 attached integrally to the lower side of the body part 2 so as to protect the knuckles of the hand. Furthermore, a protection member 6 is attached integrally to the outer surface of each finger part 3 so as to protect each finger. The respective protection members 4, 5 and 6 are made of soft TPR or TPV so as to be resistant to the impacts applied from the outside and to protect the corresponding portions from the impacts. Of course, the protection members 5 and 6 have joint portions 5*a* and 6*a* formed thereon to improve the movements of the knuckles of the hand and the joints of each finger.

Under the above-mentioned configuration of the conventional glove, accordingly, if an impact I applied from the outside is blocked and decreased by means of the protection members 4, 5 and 6 when the glove is worn, the corresponding portions are protected, and further, the movements of the knuckles of the hand and the joints of each finger are ensured by means of the joint portions 5*a* and 6*a*, thereby allowing the wearer to conduct his or her work safely.

In most cases, also, adhesive members 7 are used to integrally attach the respective protection members 4, 5 and 6 to the main part 1.

However, the conventional working glove as well as the glove as disclosed in U.S. Pat. No. 7,406,719 has some problems. First, the protection members for protecting the knuckles of the hand and the fingers are attached flattedly to the main part so that the main part corresponding to the protection members comes into flat contact with the knuckles of the hand and the joints of each finger. Accordingly, the impact I applied to the protection member is transmitted directly to the corresponding portion of the finger f in a direction of an arrow indicated by a dotted line, and the spaces for the movements of the knuckles of the hand and the joints of the fingers are not sufficiently provided. Further, the fingers of the hand are not sufficiently surroundedly protected.

Besides, the protection members are made of a hard heavyweight material, thereby lowering the wearer's wearing comfort to accumulate his or her fatigue.

OBJECT AND SUMMARY OF INVENTION

Technical Problem

Accordingly, the present invention has been made in view of the above-mentioned problems occurring in the prior art, and it is an object of the present invention to provide a glove that is capable of effectively protecting the knuckles of the hand and the joints of fingers, improving the movements of the knuckles of the hand, the joints of fingers, the fingers, and the whole portion of the hand, entirely protecting all fingers of the hand, and providing lightness and excellent wearing comfort to reduce a wearer's fatigue.

Technical Solution

To accomplish the above-mentioned object, according to the present invention, there is provided a glove including: a main part having a body part formed to insert the back and palm of the wearer's hand and finger parts formed to insert the wearer's fingers in such a manner as to communicate with the body part; a protection member having a knuckle protection member formed integrally with the body part of the main part and having accommodation portions formed to accommodate the knuckles of the wearer's hand therein and finger protection members formed integrally with the finger parts of the main part and having accommodation portions formed to accommodate the joints of the wearer's fingers therein in such a manner as to be bendable according to the movements of the fingers; and a cover member formed integrally with the outer surface of the protection member.

According to the present invention, desirably, the protection member is selected from one of PHYLON (foam ethylene vinyl acetate), EVA (ethylene vinyl acetate), and PV (poly vinyl) and a combination thereof.

According to the present invention, desirably, each finger protection member has finger segment portions formed between the accommodation portions in such a manner as to be rounded correspondingly to the sectional shape of each finger segment.

According to the present invention, desirably, the cover member includes a knuckle cover member formed integrally with the outer surface of the knuckle protection member and finger cover members formed integrally with the outer surfaces of the finger protection members.

According to the present invention, desirably, the cover member is selected from one of TPU (thermoplastic polyurethane), TPR (thermoplastic rubber), and PEBAX (polyether-block-amide) and a combination thereof.

According to the present invention, desirably, each finger protection member has concave portions formed in the opposite directions of the accommodation portions thereof, and each finger cover member has concave portions formed correspondingly to the concave portions of each finger protection member.

According to the present invention, desirably, the body part of the main part has groove portions formed integrally with the accommodation portions of the knuckle protection member to accommodate the knuckles of the wearer's hand therein, and each finger part of the main part has groove portions formed integrally with the accommodation portions of each finger protection member to accommodate the joints of each wearer's finger therein.

According to the present invention, desirably, the glove further includes intermediate members located correspondingly to the knuckle protection member and the finger protection members to allow the knuckle protection member and the finger protection members to be attached integrally to the body part and the finger parts of the main part.

According to the present invention, desirably, space portions are formed between the body part of the main part and the accommodation portions of the knuckle protection member and space portions are formed between each finger part of the main part and the accommodation portions of each finger protection member.

According to the present invention, desirably, the glove is one of working, military, sports, and motorcycle gloves.

Advantageous Effects

According to the present invention, the glove is provided with the spaces formed on the corresponding portions to the knuckles of the wearer's hand and the joints of the wearer's fingers, thereby ensuring the movements of the knuckles of the wearer's hand and the joints of the wearer's fingers and preventing the impact applied from the outside from being transmitted directly to the knuckles of the wearer's hand and the joints of the wearer's fingers, and further, the glove is provided with the finger protection members formed to the corresponding shapes to the fingers in a longitudinal direction thereof to effectively protect all of the fingers from the outside, the finger protection members being made of a lightweight soft material to provide an excellent wearing comfort so that the wearer's fatigue can be remarkably reduced. Further, the glove according to the present invention is provided with the cover member made of a hard material to protect the protection member as well as the hand from the outside.

BRIEF DESCRIPTION OF DRAWINGS

FIGS. 7*a* to 7*c* are sectional views taken along the line VII-VII of FIG. 6, wherein FIG. 7*a* shows the state wherein the knuckles of the hand are unfolded, FIG. 7*b* shows the state wherein the knuckles of the hand are folded, and FIG. 7*c* shows the deformation occurring when an external impact is applied;

FIGS. 9*a* to 9*c* are sectional views taken along the line IX-IX of FIG. 8, wherein FIG. 9*a* shows the state wherein the joints of fingers are unfolded, FIG. 9*b* shows the state wherein the joints of fingers are folded, and FIG. 9*c* shows the deformation occurring when an external impact is applied;

FIGS. 10*a* to 10*c* are sectional views taken along the line X-X of FIG. 8, wherein FIG. 10*a* shows the positions of the finger segments in the state where the finger joints are unfolded, FIG. 10*b* shows the positions of the finger segments in the state where the finger joints are folded, and FIG. 10*c* shows the deformation occurring when an external impact is applied;

DETAILED DESCRIPTION OF THE EMBODIMENTS

Figure 1:
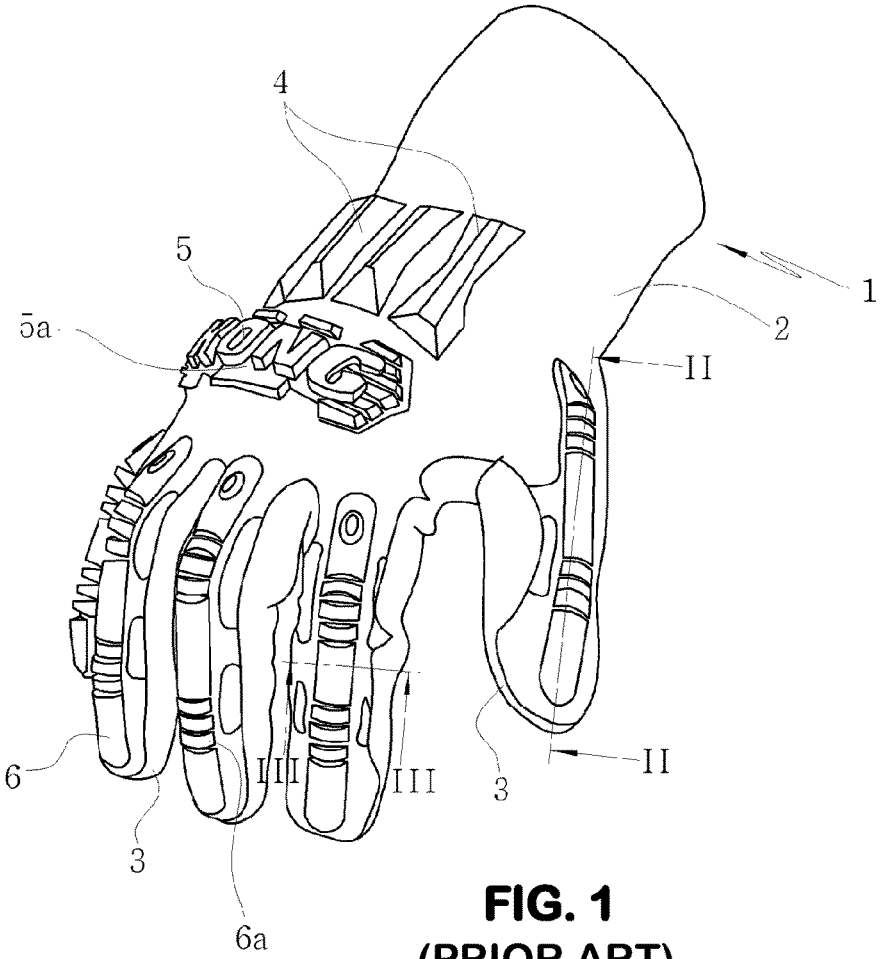
FIG. 1 (PRIOR ART)
FIG. 1 is a perspective view showing a conventional working glove.
Figure 2:
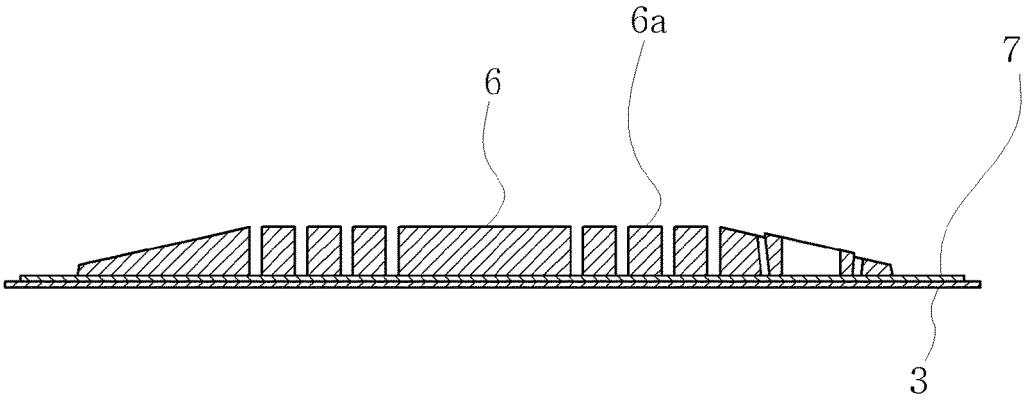
FIG. 2 (PRIOR ART)
FIG. 2 is a sectional view taken along the line II-II of FIG. 1.
Figure 3:
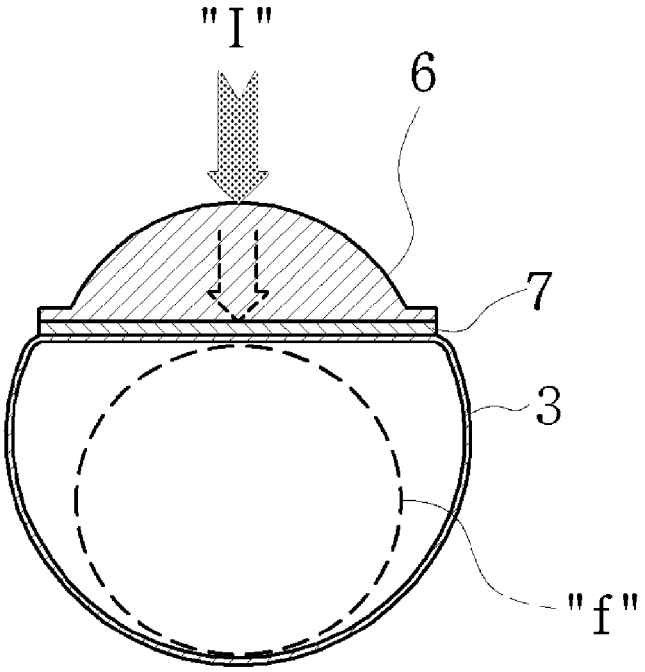
FIG. 3 (PRIOR ART)
FIG. 3 is a sectional view taken along the line III-III of FIG. 1.
Figure 4:
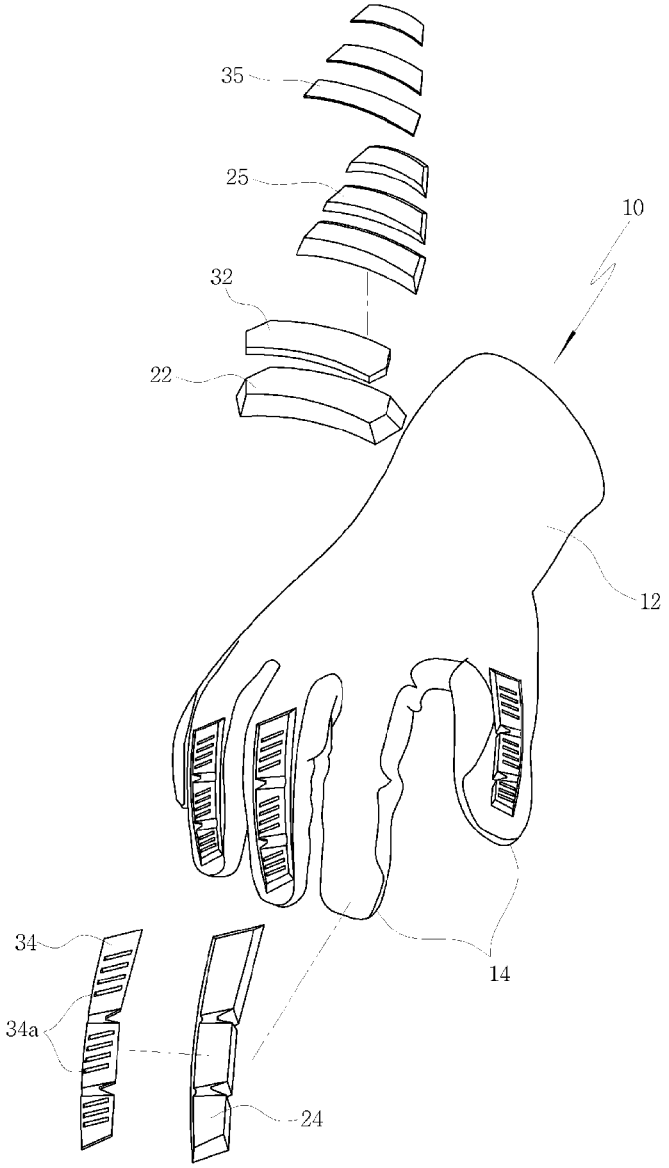
FIG. 4 is an exploded perspective view showing a glove according to a first embodiment of the present invention.
Figure 5A:
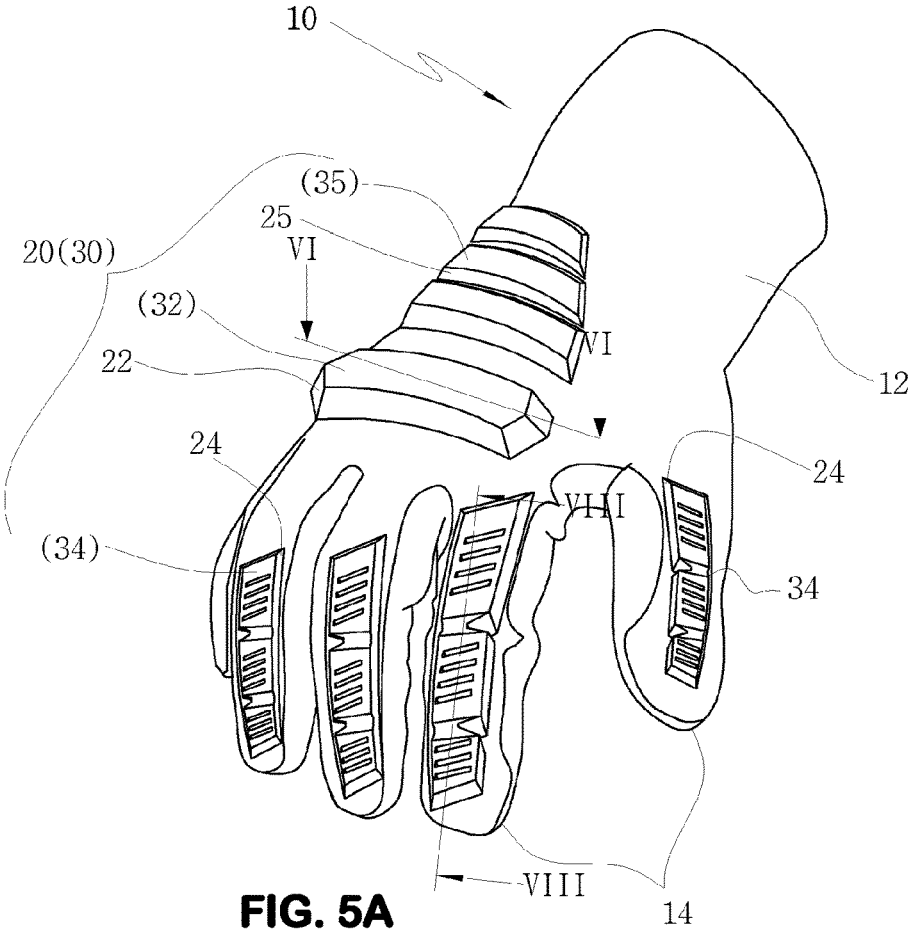
FIG. 5*a* is a perspective view showing the glove of FIG. 4.
Figure 5B:
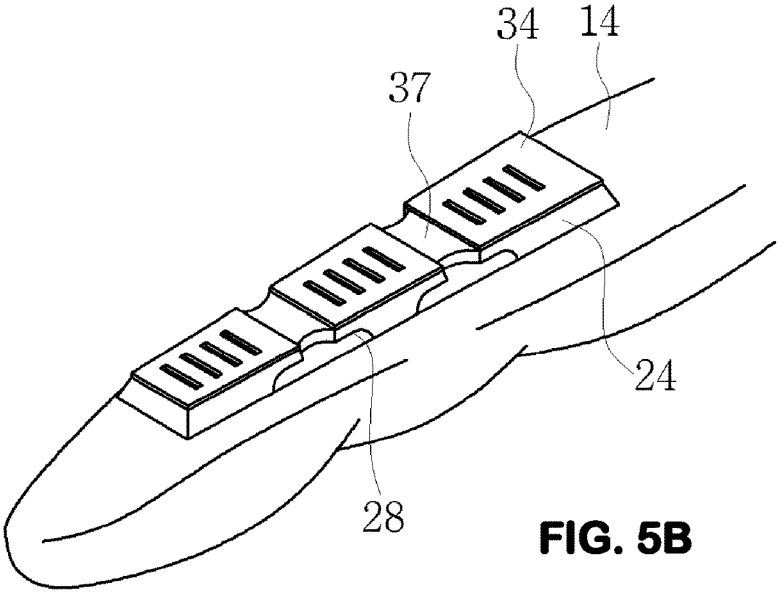
FIG. 5*b* is a partially enlarged perspective view showing one figure part of the glove according to the first embodiment of the present invention.
Figure 6:
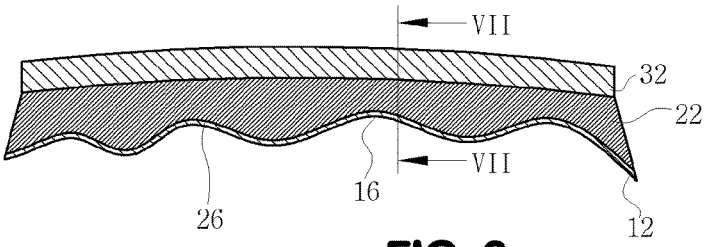
FIG. 6 is a sectional view taken along the line VI-VI of FIG. 5*a;*
Figure 7A:
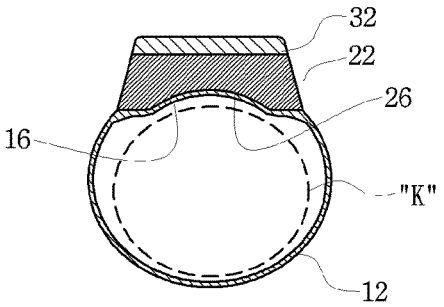
Figure 7B:
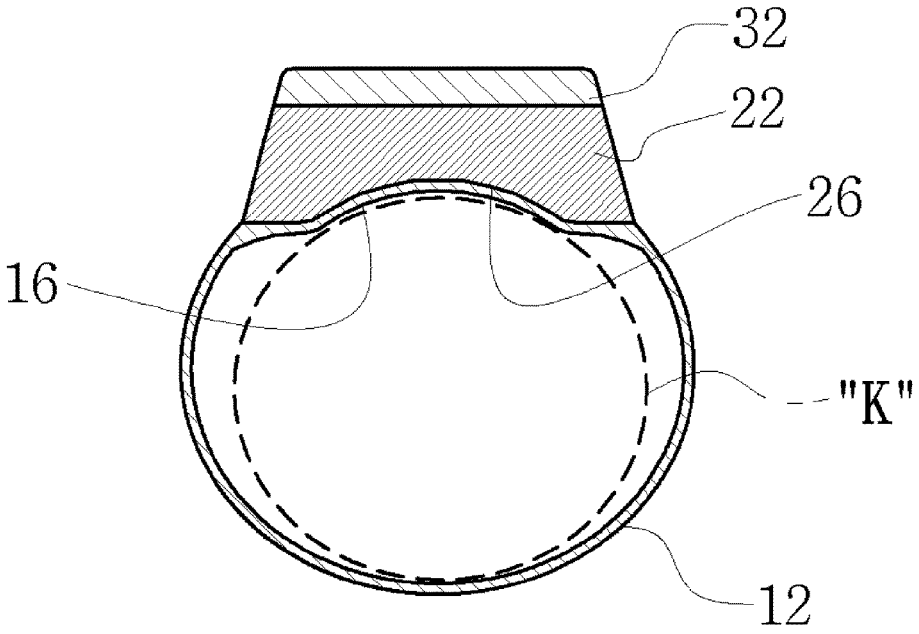
Figure 7C:
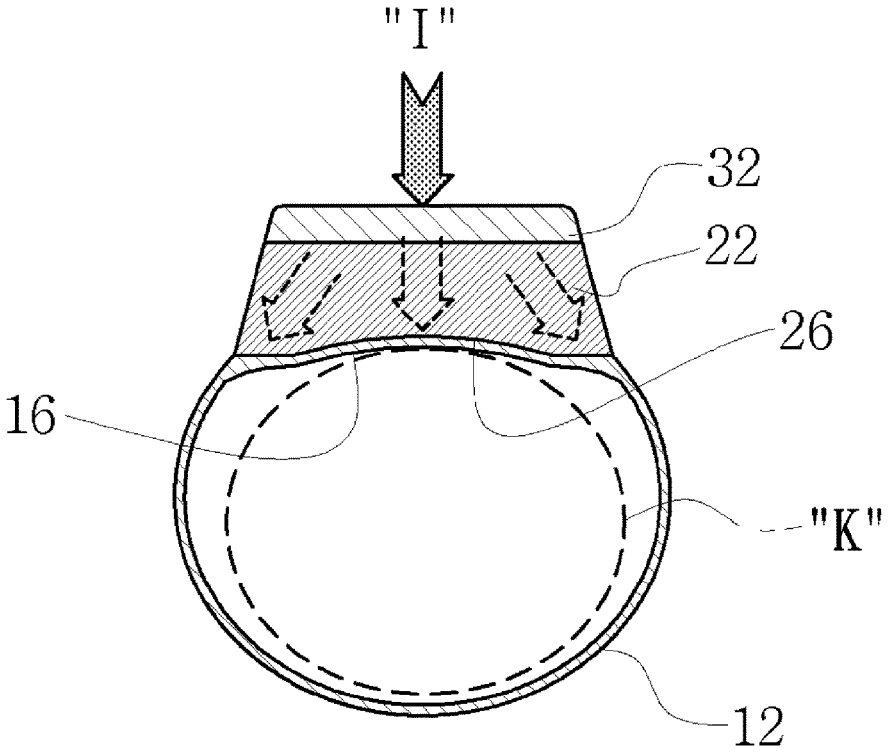
Figure 8:
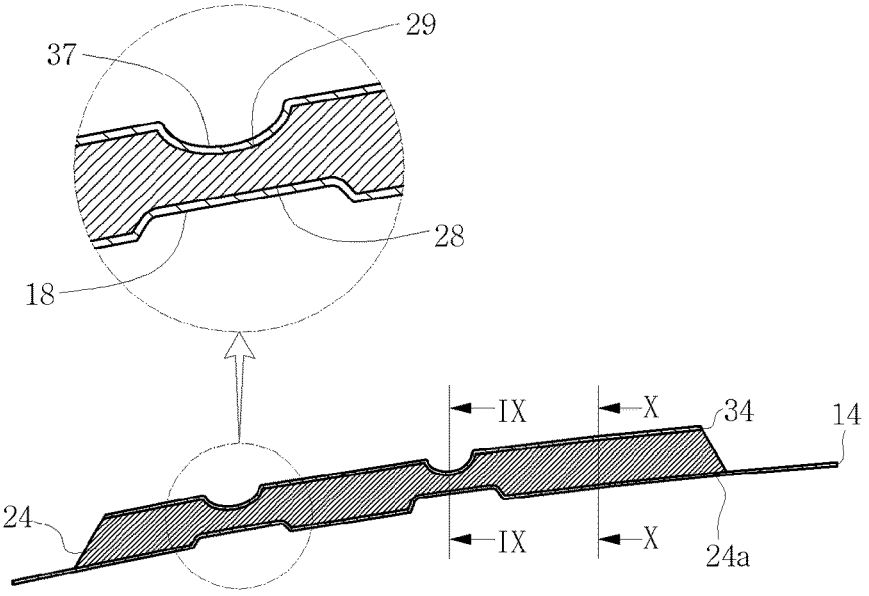
FIG. 8 is a sectional view taken along the line VIII-VIII of FIG. 5*a;*
Figure 9A:
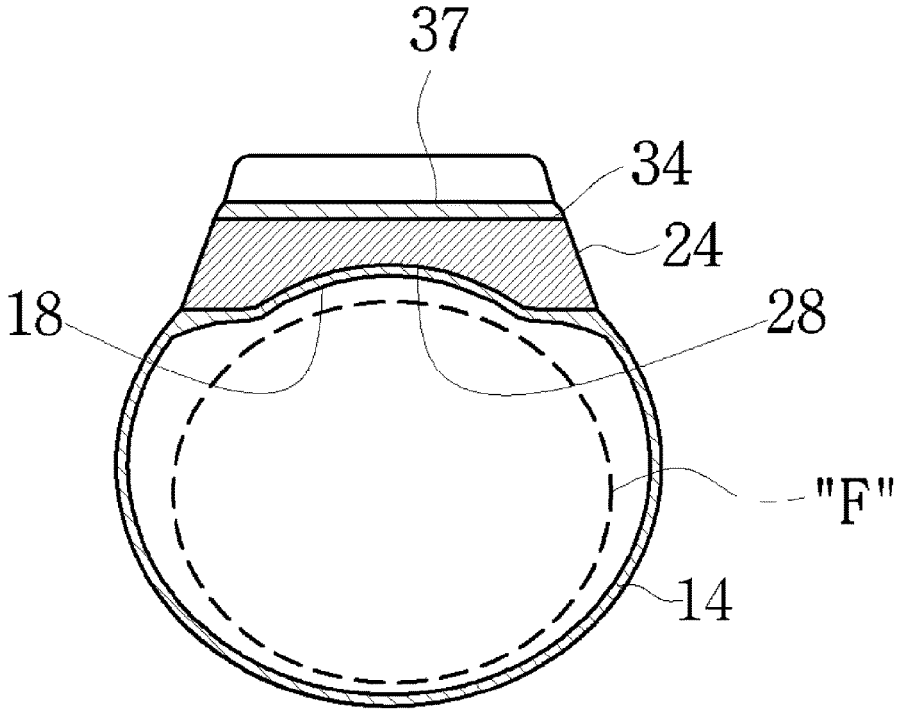
Figure 9B:
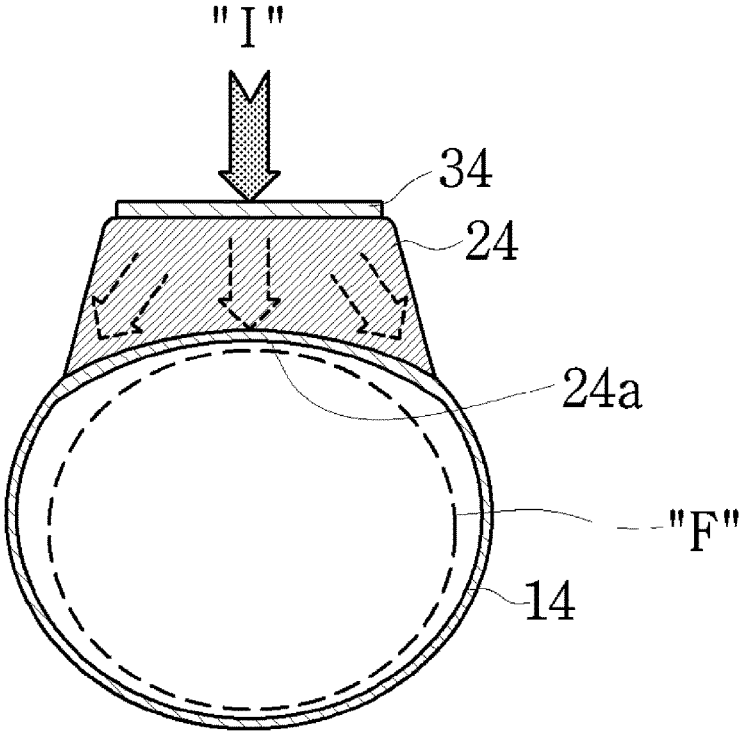
Figure 9C:
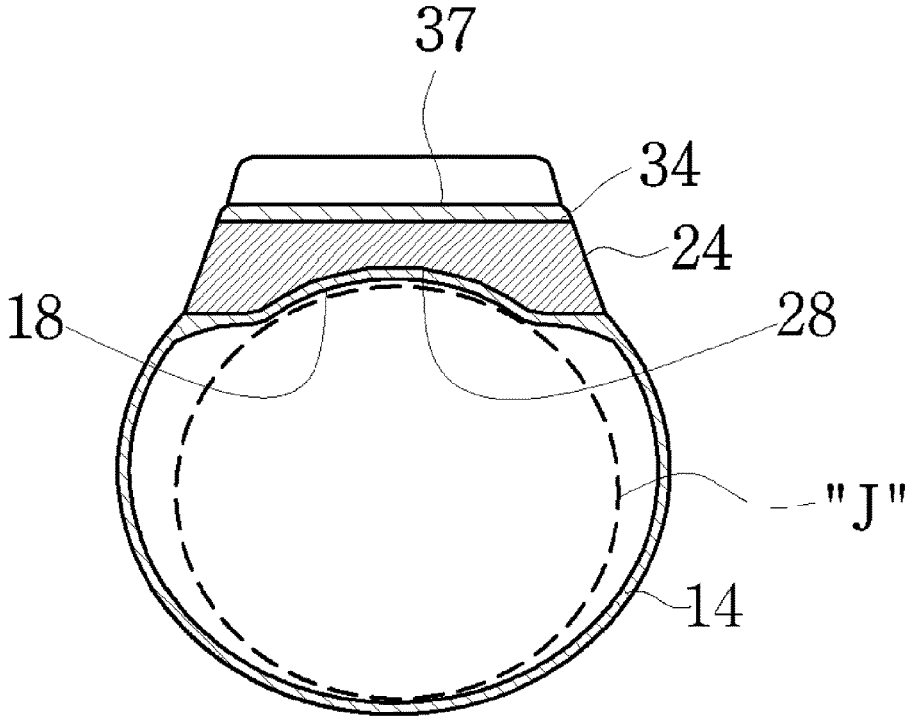
Figure 10A:
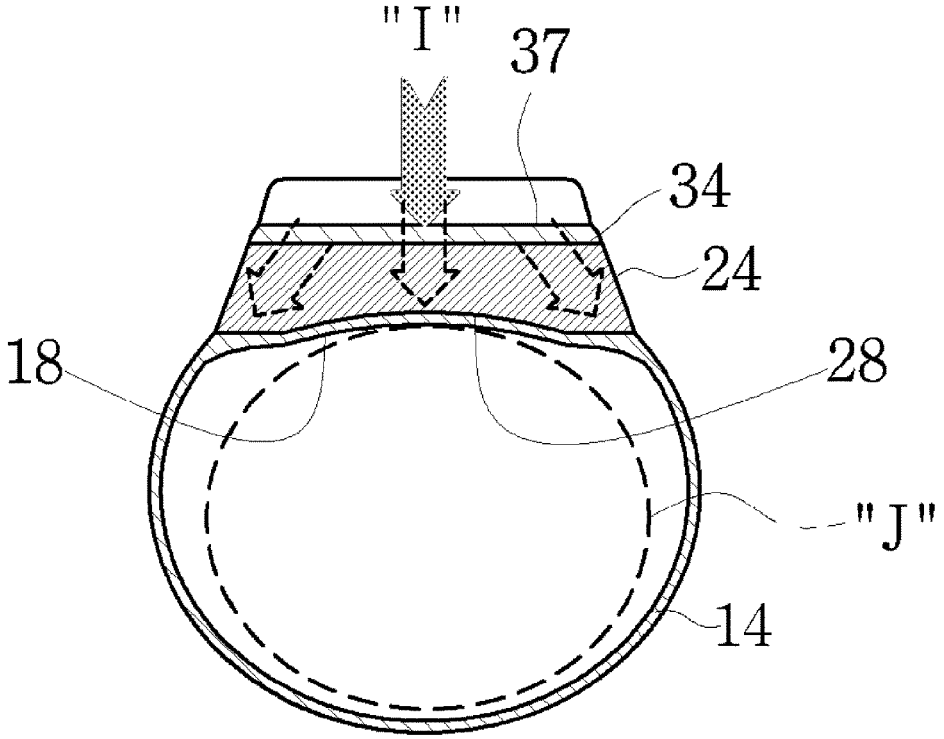
Figure 10B:
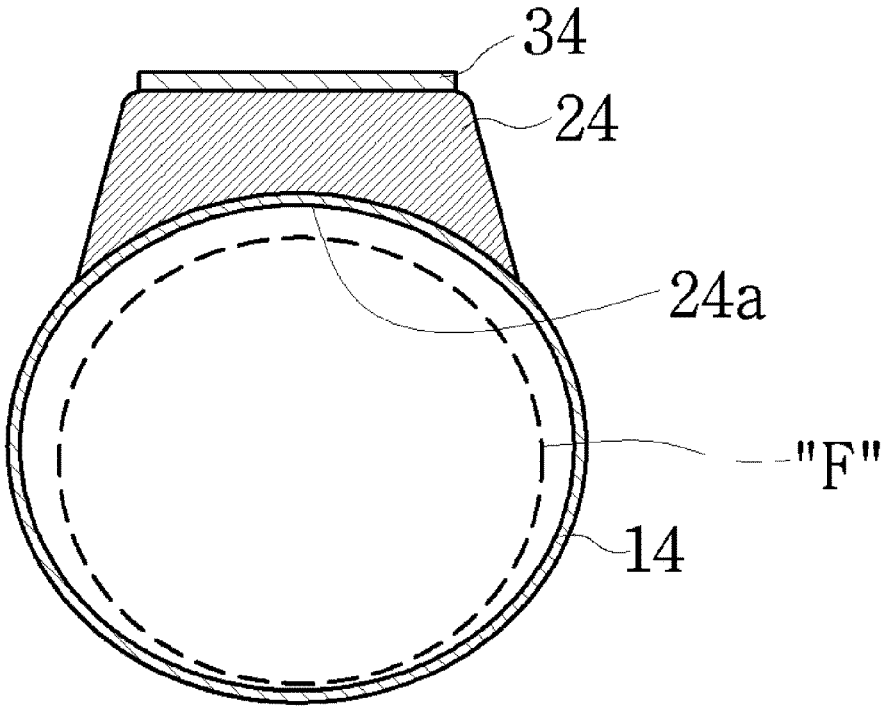
Figure 10C:
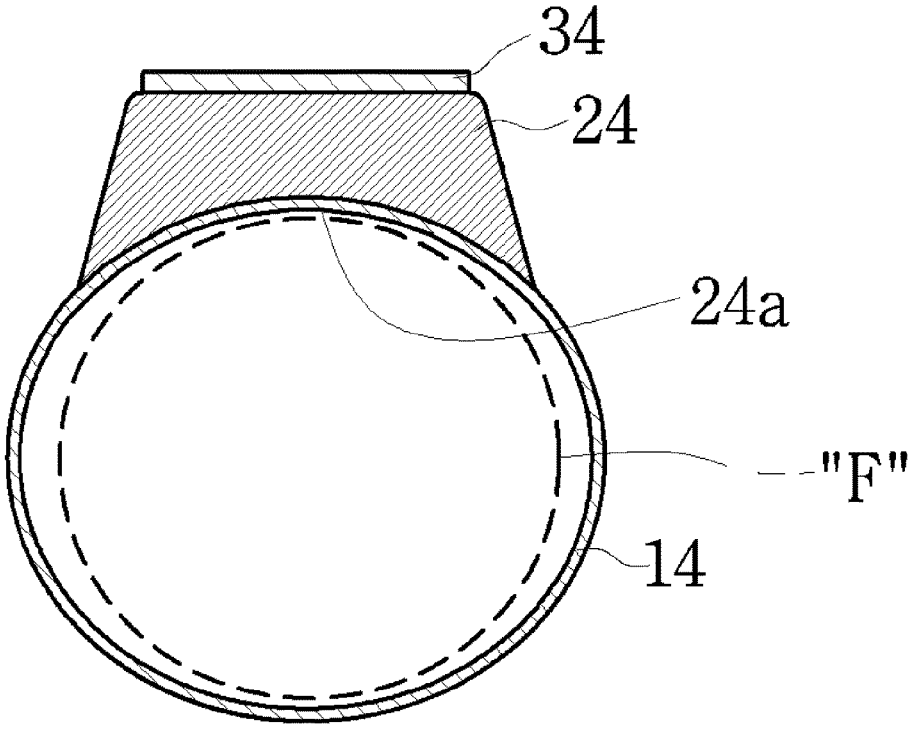

Hereinafter, an explanation on a glove according to the present invention will be in detail given with reference to the attached drawing.

As shown in FIGS. 4 to 10*c*, a glove according to a first embodiment of the present invention basically includes a main part 10. The main part 10 is made of various fabrics or synthetic resins according to its purpose or a demander's need and also has various sizes according to the hand sizes of wearers.

The main part 10 includes a body part 12 formed to the shape corresponding to the shape of the hand and finger parts 14 communicating with the body part 12. The body part 12 is formed to insert the palm, back and knuckles K of the hand, and the finger parts 14 to insert the fingers.

Especially, groove portions 16 are formed on the boundary between the body part 12 and the finger parts 14 to accommodate the knuckles K of the hand therein, and groove portions 18 are formed on each finger part 14 to accommodate the joints J of each finger therein. If the hand is at a normal state, that is, if the hand is unfolded or the fingers are unfolded, the groove portions 16 and 18 are spaced apart from the knuckles K of the hand and the joints J of the fingers, and contrarily, if the knuckles K of the hand or the joints J of the fingers are folded during working, they are inserted or accommodated into the corresponding groove portions 16 and 18.

Under the above-mentioned configuration, if a given impact I is applied to a cover member 30 and a protection member 20 as will be discussed later, the impact I is distributed or absorbed in the groove portions 16 and 18 and then transmitted to the knuckles K of the hand or the joints J of the fingers, thereby ensuring high safety. Further, the knuckles K of the hand or the joints J of the fingers are accommodated in the groove portions 16 and 18, thereby ensuring their free movements.

Further, the glove according to the present invention includes the protection member 20 for protecting the wearer's hand, especially, the back of the hand, the knuckles K of the hand, and the fingers. The protection member 20 is formed integrally with the outer surface of the body part 12 and the outer surface of each finger part 14, respectively. That is, a knuckle protection member 22 is formed integrally with the outer surface of the body part 12 of the main part 10 so as to protect the knuckles K of the hand, and finger protection members 24 are formed integrally with the outer surfaces of the finger parts 14 so as to protect the fingers. Of course, back-of-hand protection members 25 are formed integrally with the outer surface of the body part 12 of the main part 10 so as to protect the back of the hand.

In this case, the respective protection members 22, 24 and 25 are desirably provided to allow the wearer's hand and fingers to be freely moved, and they are strong against external impacts. Accordingly, the protection members 22, 24 and 25 are selected from one of PHYLON (foam ethylene vinyl acetate), EVA (ethylene vinyl acetate), and PV (poly vinyl) and a combination thereof, which have excellent impact absorption performance and lightness.

Particularly, the knuckle protection member 22 has accommodation portions 26 formed to protect the knuckles K of the wearer's hand as well as to accommodate the knuckles K of the wearer's hand therein. The accommodation portions 26 are formed correspondingly to the groove portions 16 of the main part 10 in such a manner as to be attached integrally to the outer surfaces of the groove portions 16 to accommodate the knuckles K of the wearer's hand inserted into the groove portions 16 therein.

Through the formation of the accommodation portions 16, the knuckles K of the hand are spaced apart from the accommodation portions 26 if they are unfolded, and contrarily, if the knuckles K of the hand are folded, they are accommodated into the accommodation portions 26 through the groove portions 16 so that they can be folded comfortably and stably. If the impact I is applied from the outside, further, the impact I is distributed or absorbed in the accommodation portions 26, thereby safely protecting the knuckles K of the wearer's hand.

Further, each finger protection member 24 has accommodation portions 28 formed to protect the wearer's fingers as well as to accommodate the joints J of each finger therein. The accommodation portions 26 are formed correspondingly to the groove portions 18 of the main part 10 in such a manner as to be attached integrally to the outer surfaces of the groove portions 18 to accommodate the joints J of each finger inserted into the groove portions 18 therein. The accommodation portions 26 are of course bendable according to the movement of each finger.

Through the formation of the accommodation portions 28, the joints J of each finger are spaced apart from the accommodation portions 28 if the finger is unfolded or the joints J are unfolded, and contrarily, if the joints J of each finger are folded, they are accommodated into the accommodation portions 28 through the groove portions 18 of the main part 10 so that they can be folded comfortably and stably. If the impact I or an external force is applied from the outside, further, the impact I or external force is distributed or absorbed in the accommodation portions 28, thereby safely protecting the joints J of each finger.

Further, each finger protection member 24 has a plurality of concave portions 29 formed to allow the joints J of each finger to be more gently and freely moved. The concave portions 29 are desirably formed in the opposite directions of the accommodation portions 28 or in the corresponding portions to the accommodation portions 28. Through the formation of the concave portions 29, accordingly, the accommodation portions 28 can be more freely folded or unfolded upon the movement of each finger, especially when the joints J of each finger are folded or unfolded, thereby improving the movements of all fingers.

According to the present invention, further, each finger protection member 24 has finger segment portions 24*a* formed between the accommodation portions 28 in such a manner as to be rounded correspondingly to the sectional shape of each finger segment. If the impact I is applied to the segment portions 24*a* of each finger protection member 24, accordingly, the impact I is distributed or absorbed through the rounded segment portions 24*a*, thereby ensuring the safety of the finger segments.

On the other hand, the integration of the main part 10 with the protection member 20 is carried out through various molding, attaching, or bonding processes.

According the present invention, further, the glove includes the cover member 30 formed integrally with the protection member 20 so as to protect the protection member 20 from the outside. The cover member 30 is formed of a strong material for stably protecting the protection member 20. In addition to protect the protection member 20, of course, the cover member 30 serves to finally protect the wearer's hand from the external impact.

The cover member 30 is formed correspondingly to the protection member 20, and in more detail, the cover member 30 includes a knuckle cover member 32, finger cover members 34 and back-of-hand cover members 35, which correspond to the knuckle protection member 22, the finger protection members 24 and the back-of-hand protection members 25. The cover members 32, 34 and 35 are formed integrally with the corresponding protection members 22, 24 and 25 by means of various molding methods.

Further, the respective cover members 32, 34 and 35 are selected from one of TPU (thermoplastic polyurethane), TPR (thermoplastic rubber), and PEBAX (polyether-block-amide) and a combination thereof, which have excellent stiffness and repulsive elasticity so as to effectively and stably protect the corresponding protection members 22, 24 and 25 from the outside.

On the other hand, each finger cover member 34 has concave portions 37 formed correspondingly to the concave portions 29 of each finger protection member 24 to allow the wearer's finger to be gently moved.

Further, each finger cover member 34 is extended integrally with the end portion of the corresponding finger part 14 of the main part 10 so as to more stably protect the tip of each finger from the outside.

So as to achieve the lightness of each finger cover member 34, furthermore, a plurality of incised portions 34*a* is selectively formed on each finger cover member 34. Of course, the finger cover members 34 are formed to the shapes corresponding to the shapes of the finger protection members 24, and they are obviously molded or changed in shape within the range wherein they do not limit the protective functions and movements for the fingers.

Of course, the integration of the protection member 20 with the cover member 30 is carried out through various molding, attaching, or bonding processes.

Figure 11:
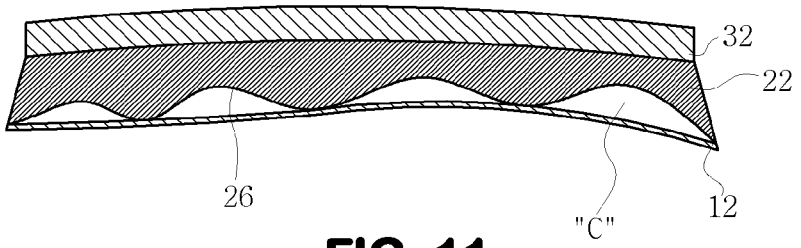
FIGS. 11 and 12 are sectional views showing a glove according to a second embodiment of the present invention, which are similar to FIGS. 6 and 8.
Figure 12:
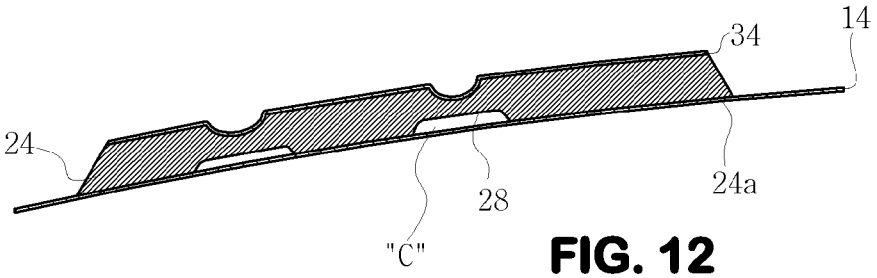

As shown in FIGS. 11 and 12, if the main part 10 is made of an elastic or soft material, the groove portions 16 and 18 are not formed on the main part 10. That is, space portions as will be discussed later corresponding to the groove portions 16 and 18 are formed, thereby providing the same effects generated from the groove portions 16 and 18.

In this case, space portions C are formed between the body part 12 of the main part 10 and the accommodation portions 26 of the knuckle protection member 22, and space portions C are between each finger part 14 of the main part 10 and the accommodation portions 28 of each finger protection member 24.

Accordingly, the knuckles K of the hand and the joints J of the fingers accommodate the space portions C and the accommodation portions 26 and 28 of the protection member 20 through the elasticity or softness of the body part 12 and the finger parts 14 of the main part 10, thereby ensuring the movements and safety of the knuckles K of the hand and the joints J of the fingers.

Figure 13:
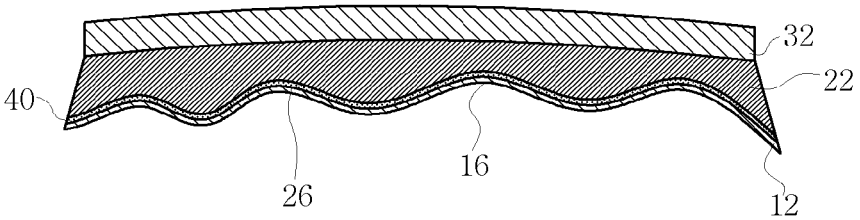
FIGS. 13 and 14 are sectional views showing a glove according to a third embodiment of the present invention, which are similar to FIGS. 6 and 8.
Figure 14:
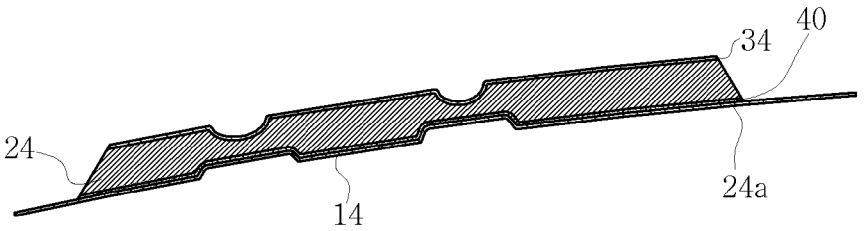

As shown in FIGS. 13 and 14, a glove according to a second embodiment of the present invention includes intermediate members 40 adapted to allow the protection members 22, 24 and 25 to be gently integrated with the corresponding portions of the main part 10.

The intermediate members 40 are located correspondingly to the knuckle protection member 22, the finger protection members 24 and the back-of-hand protection member 25 of the protection member 20. Further, the intermediate members 40 are desirably low in thickness so that the protection members 22, 24 and 25 can come into close contact with the body part 12 and the finger parts 14 of the main part 10. Further, the intermediate members 40 are desirably made of PU (polyurethane) having excellent adhesiveness.

Upon the integration process of the main part 10 with the protection member 20, of course, the intermediate members 40 are disposed between the main part 10 and the protection member 20 in such a manner as to be attached to them at the same time.

On the other hand, the glove according to the present invention can be manufactured in various ways. For example, the protection member 20 and the cover member 30 are sequentially integrated with the main part 10, and otherwise, after the protection member 20 is integrated with the cover member 30, they are integrated with the main part 10.

Especially, the glove according to the present invention can be applied to various industrial fields in which the wearer's hand should be protected from external environments and at the same time his or her hand and fingers are freely movable. That is, the glove according to the present invention can be used for the purposes of working, military, sports, and motorcycle gloves.

Now, an explanation on the operation mode and operating effects of the glove according to the present invention will be in detail given.

If the glove according to the present invention is worn on a user, the knuckles K of the wearer's hand are located spaced apart from the groove portions 16 of the body part 12 by a given distance in a normal state, that is, in the state where the wearer's hand is unfolded. Further, the joints J of each finger are located spaced apart from the groove portions 18 of each finger part 14 by a given distance, and the finger segments F of each finger are located on the rounded finger segment portions 24*a* of each finger member 24 of the protection member 20.

Of course, as shown in FIGS. 11 and 12, if the space portions C are formed on the body part 12 and each finger part 14, instead of the groove portions 16 and 18, the knuckles K of the hand come into contact with the body part 12 of the main part 10 at the positions of the accommodation portions 26 of the knuckle protection member 22 of the protection member 20. In the same manner as above, the joints J of each finger come into contact with each finger part 14 of the main part 10 at the positions of the accommodation portions 28 of each finger protection member 24 of the protection member 20.

In any case, accordingly, the knuckles K of the wearer's hand are located spaced apart from the accommodation portions 26 of the knuckle protection member 22 or the groove portions 16 or the space portions C of the body part 12, and the joints J of each finger are located spaced apart from the accommodation portions 28 of each finger protection member 24 or the groove portions 18 or the space portions C of each finger part 14. Moreover, the finger segments F of each finger are located curvedly surrounded by the rounded finger segment portions 24*a* of each finger protection member 24.

If the external impact I or force is applied to the glove in the state wherein the wearer's hand is unfolded, the impact I is primarily absorbed through the knuckle cover member 32, the finger cover members 34 and the back-of-hand cover members 35.

Accordingly, the impact I, which passes through the respective cover members 32, 34 and 35, is transmitted to the knuckle protection member 22, the finger protection members 24 and the back-of-hand protection members 25 and secondarily released.

Particularly, the impact I transmitted to the knuckle protection member 22 and the finger protection members 24 is distributed and released or absorbed like the arrow indicated by a dotted line. At this time, the knuckles K of the hand and the joints J of the fingers are not brought into direct contact with the knuckle protection member 22 and the finger protection members 24, but they are located in the accommodation portions 26 and 28 and the space portions C, so that they are more safely protected. Of course, the impact I is also distributed by the rounded structures of the finger segment portions 24*a* of each finger protection member 24, so that the finger segments F of each finger can be protected safely. Accordingly, the entire hand of the wearer can be safely protected from the external impact I.

On the other hand, if the wearer's hand is folded or grasp an object so as to conduct his or her work, the knuckles K of the hand and the joints J of each finger are bent or folded. At this time, the knuckles K of the hand are folded and at the same time moved to the accommodation portions 26 of the knuckle protection member 22 through the groove portions 16 of the main part 10 or are foldedly inserted into the space portions C, so that the knuckles K of the hand are folded easily and comfortably.

Further, the joints J of each finger are folded and at the same time moved to the accommodation portions 28 of each finger protection member 24 through the groove portions 18 of the main part 10 or are foldedly inserted into the space portions C, so that the joints J of each finger are folded easily and comfortably.

Of course, even if the external impact I is applied in the state where the knuckles K of the hand and the joints J of each finger are folded, the impact I is distributed and absorbed by means of the accommodation portions 26 of the knuckle protection member 22 and the accommodation portions 28 of each finger protection member 24 or by means of the space portions C, so that the joints J of each finger and all fingers can be safely protected.

Accordingly, the knuckles K of the hand are located in the accommodation portions 26 of the knuckle protection member 22 and the joints J of each finger are located in the accommodation portions 28 of each finger protection member 24, so that they can be safely protected from the external impact and their movement can be ensured by the spaces of the accommodation portions 26 and 28.

Furthermore, the protection member 20 is made of a lightweight material having excellent impact absorption properties, and the cover member 30 is made of a material having excellent stiffness and repulsive elasticity. Accordingly, the cover member 30 absorbs the external impact and protects the protection member 20 from the external impact, and the protection member 20 distributes and absorbs the external impact and ensures the movements of the knuckles K of the hand and the joints J of each finger. Further, the glove according to the present invention can be lightweight according to the material characteristics of the protection member 20, thereby reducing the fatigue of the wearer and improving his or her wearing comfort.

Accordingly, the glove according to the present invention can protect the wearer's hand to a great extent from various environments like a bad working place, playground in the military, sports center, motorcycle field, and so on, while ensuring the movement of his or her hand to the maximum.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

| Explanations of Reference Numerals in the Drawing | |
|---|---|
| 10: main part | 12: body part |
| 14: finger part | 16, 18: groove portion |
| 20: protection member | 22: knuckle protection member |
| 24: finger protection member | |
| 26, 28: accommodation portion | |
| 30: cover member | 32: knuckle cover member |
| 34: finger cover member | |

The invention claimed is:

1. A glove comprising:

a main part comprising a body part formed to receive back and palm of a wearer's hand and finger parts formed to receive the wearer's fingers, the finger parts are in communication with the body part;

a protection member comprising:

a knuckle protection member formed integrally with the body part and comprising accommodation portions formed to accommodate knuckles of the wearer's hand therein; and finger protection members formed integrally with the finger parts and comprising accommodation portions formed to accommodate joints of the wearer's fingers therein, the finger protection members are bendable according to movements of the wearer's fingers;

a cover member formed integrally with an outer surface of the protection member;

intermediate members located correspondingly to the knuckle protection member and the finger protection members to integrally attach the knuckle protection member and the finger protection members to the body part and the finger parts; and first space portions formed between the body part and the accommodation portions of the knuckle protection member; and second space portions formed between each finger part and the accommodation portions of each finger protection member.

2. The glove according to claim 1, wherein the protection member is selected from one of a foam ethylene vinyl acetate (PHYLON), an ethylene vinyl acetate (EVA), a poly vinyl (PV) and a combination thereof.

3. The glove according to claim 1, wherein each finger protection member comprises finger segment portions formed between the accommodation portions of said each finger protection member, the finger segment portions are rounded correspondingly to a sectional shape of a finger segment of said each finger protection member.

4. The glove according to claim 1, wherein the cover member comprises a knuckle cover member formed integrally with an outer surface of the knuckle protection member and finger cover members formed integrally with outer surfaces of the finger protection members.

5. The glove according to claim 4, wherein the cover member is selected from one of a thermoplastic polyurethane (TPU), a thermoplastic rubber (TPR), a polyether-block-amide (PEBAX) and a combination thereof.

6. The glove according to claim 4, wherein each finger protection member comprises concave portions formed in opposite directions of the accommodation portions thereof, and each finger cover member comprise concave portions formed correspondingly to the concave portions of said each finger protection member.

7. The glove according to claim 1, wherein the body part comprises groove portions formed integrally with the accommodation portions of the knuckle protection member, and each finger part comprises groove portions formed integrally with the accommodation portions of said each finger protection member.

8. The glove according to claim 1 is one of working, military, sports, and motorcycle gloves.

9. A glove comprising:

a main part comprising a body part formed to receive back and palm of a wearer's hand and finger parts formed to receive the wearer's fingers, the finger parts are in communication with the body part;

a protection member comprising:

a knuckle protection member formed integrally with the body part and comprising accommodation portions formed to accommodate knuckles of the wearer's hand therein; and finger protection members formed integrally with the finger parts and comprising accommodation portions formed to accommodate joints of the wearer's fingers therein, the finger protection members are bendable according to movements of the wearer's fingers;

a cover member formed integrally with an outer surface of the protection member;

first space portions formed between the body part and the accommodation portions of the knuckle protection member; and second space portions formed between each finger part and the accommodation portions of each finger protection member;

wherein the cover member is selected from one of a thermoplastic polyurethane (TPU), a thermoplastic rubber (TPR), a polyether-block-amide (PEBAX) and a combination thereof; and wherein each finger protection member comprises concave portions formed in opposite directions of the accommodation portions thereof, and each finger cover member comprise concave portions formed correspondingly to the concave portions of said each finger protection member.

10. The glove according to claim 9, further comprising intermediate members located correspondingly to the knuckle protection member and the finger protection members to integrally attach the knuckle protection member and the finger protection members to the body part and the finger parts.

11. The glove according to claim 9, wherein the protection member is selected from one of a foam ethylene vinyl acetate (PHYLON), an ethylene vinyl acetate (EVA), a poly vinyl (PV) and a combination thereof.

12. The glove according to claim 9, wherein each finger protection member comprises finger segment portions formed between the accommodation portions of said each finger protection member, the finger segment portions are rounded correspondingly to a sectional shape of a finger segment of said each finger protection member.

13. The glove according to claim 9, wherein the cover member comprises a knuckle cover member formed integrally with an outer surface of the knuckle protection member and finger cover members formed integrally with outer surfaces of the finger protection members.

14. The glove according to claim 9, wherein the body part comprises groove portions formed integrally with the accommodation portions of the knuckle protection member, and each finger part comprises groove portions formed integrally with the accommodation portions of said each finger protection member.

15. The glove according to claim 9 is one of working, military, sports, and motorcycle gloves.

* * * * *